US006604337B2

(12) United States Patent
Close et al.

(10) Patent No.: US 6,604,337 B2
(45) Date of Patent: Aug. 12, 2003

(54) AUTOMATIC LIDDER AND/OR UN-LIDDER SYSTEM AND METHOD

(75) Inventors: Donald R. Close, Fairfax, VA (US); Mark Bankard, Sykesville, MD (US); William D. Finch, New Windsor, MD (US); Robert Cutlip, Millersville, MD (US); Robert D. Lundahl, Frederick, MD (US); Dwight Koogle, Middletown, MD (US)

(73) Assignee: The United States of America as represented by the United States Postal Service, Washington, DC (US)

( * ) Notice: Subject to any disclaimer, the term of this patent is extended or adjusted under 35 U.S.C. 154(b) by 0 days.

(21) Appl. No.: 10/161,155

(22) Filed: May 30, 2002

(65) Prior Publication Data

US 2003/0009985 A1 Jan. 16, 2003

Related U.S. Application Data

(60) Provisional application No. 60/294,000, filed on May 30, 2001.

(51) Int. Cl.[7] ..... B65B 7/28; B65B 43/40; B65B 57/04

(52) U.S. Cl. ..... 53/75; 53/381.4; 53/329

(58) Field of Search ..... 53/75, 167, 329, 53/381.2, 381.4

(56) References Cited

U.S. PATENT DOCUMENTS

| | | | | | |
|---|---|---|---|---|---|
| 3,777,455 | A | | 12/1973 | Allen | |
| 3,896,607 | A | | 7/1975 | Royal | |
| 3,913,300 | A | | 10/1975 | Benzing | |
| 4,317,319 | A | * | 3/1982 | Price | 53/76 |
| 4,466,767 | A | * | 8/1984 | Meschi | 414/411 |
| 5,048,259 | A | * | 9/1991 | Cox et al. | 53/381.4 |
| 5,179,878 | A | | 1/1993 | Kranefeld et al. | |
| 5,657,617 | A | * | 8/1997 | Allen et al. | 53/381.4 |
| 5,813,199 | A | * | 9/1998 | Temburg | 53/492 |
| 5,894,711 | A | * | 4/1999 | Davidson et al. | 53/381.4 |

* cited by examiner

*Primary Examiner*—John Sipos
(74) *Attorney, Agent, or Firm*—Ivan Mlachak; Lewis and Roca LLP

(57) ABSTRACT

A device is disclosed that can automatically remove lids from trays and place lids on trays. Further the device can sense the presence of a lid on a tray and can sense the dimensions of the tray. Based on the sensed dimensions of the tray, the device can select an appropriate sized lid to place on the tray. In one embodiment of the invention, a device holds a lid with a lid manipulator having lid holders. At least one end mechanism is attached to at least one end of the lid manipulator, and the end mechanism folds the lid flaps of an appropriate lid. Guided by the lid manipulator, lids are then positioned on the tray.

11 Claims, 6 Drawing Sheets

AUTOMATIC LIDDER AND/OR UN-LIDDER SYSTEM AND METHOD

CROSS-REFERENCE TO RELATED APPLICATIONS

This application claims priority from U.S. Provisional Application No. 60/294,000 filed on May 30, 2001, entitled "Automatic Lidder and/or Un-Lidder System and Method." The contents of the above application is relied upon and expressly incorporated by reference as if fully set forth herein.

STATEMENT REGARDING FEDERALLY SPONSORED RESEARCH OR DEVELOPMENT

The invention was made by an agency of the United States government or under a contract with an agency of the United States government, the United States Postal Service ("USPS" or "Postal Service"), an independent establishment of the executive branch of the U.S. government.

BACKGROUND OF THE INVENTION

1. Field of the Invention

The invention relates generally to handling, routing and shipping containers. More specifically, the invention relates to systems and methods for automatically placing lids on, and removing lids from, shipping containers.

2. Description of the Related Art

It has been a common practice in the shipping and package delivery industry to ship items in trays such as flat trays and SPBS trays (tubs). Items such as letters and packages are placed in trays, a lid is put on them, and a strap is bound around the tray and lid assembly. One reason for this practice is to protect items from damage and loss during shipping. Also, storing and stacking uniform assemblies is more efficient in terms of time and space, than storing disparate items.

However, putting lids on trays and strapping the assembly at an intermediate location, only to have the strap cut and lids taken off so items can be further routed, is a time consuming and repetitive task. Typically, this task is done manually. A worker receives the assembly, manually cuts the strap, removes the lid, unfolds the lid, sorts and stacks the lid according to, size, and feeds the un-lidded tray to the next station. Then, after the items have undergone the required processing at the intermediate location, a worker reverses this time consuming process. The worker selects the appropriate size lid for the tray, folds it, places it on the tray, puts a strap on the assembly and feeds it to the next station. This manual process is both time-consuming and expensive. Further, the manual process subjects workers to the hazards associated with physically handling a cutter and large numbers of trays. An automated process to place lids on trays and to remove lids from trays would provide an advantage over a manual system.

One problem associated with putting lids on trays has been that items tended to get damaged when the lids are placed on the tray. The unfolded lids usually have four flaps, each corresponding to a tray side, in the finished assembly, two opposing outside flaps remain outside of the tray and the other two opposing inside flaps reside inside the tray between the items and tray sides. However, problems arise because the inside flaps can jam against items, such as letters, that are close to the edges of the tray. In the past, careful attention was needed to ensure that items were not damaged when lids were put on trays.

Accordingly, there is a need for an automated system and method for putting lids on trays and for removing lids from trays. A need also exists for a system that can perform these functions without damaging items in the trays, and to be fed into a device that will put a strap around the assembly. It would be desirable to provide a method that obtains the advantages of the present system while minimizing the need for expensive automated equipment.

SUMMARY OF THE INVENTION

In certain embodiments of the present invention there is provided a method and systems that can automatically put lids on and remove lids from different tray sizes or from a single try size. In one embodiment of the invention, a lidding device with a lid manipulator having lid holders holds a lid. Lids are held by a lid holder and at least one end mechanism attached at the end of the lid manipulator, where the end mechanism folds the lid flaps of an appropriate sized lid. Guided by the lid manipulator, lids are positioned on the tray. Trays are passed through the lidding device by automatic means such as a conveyor belt or mechanized rollers. A first advantage of the present invention is the automated handling of trays and lids.

According to another embodiment of the invention, a sensor on the lidding device sizes a tray/lid combination. When removing lids from trays, information from the sensor about the tray/lid dimension allows the lid holders to adapt to different sizes. When attaching lids, the sensor allows the lidding device to match the appropriate sized lid to a given tray. Appropriate unfolded lids are selected from a storage container. The unfolded lid flaps are folded and the lid is guided onto a tray. Thus one advantage of the invention is that a single lidding device can handle trays and lids of differing dimensions. It is not necessary to provide a single machine that is adapted to a single tray/lid size.

A further advantage of the invention is that straps which attach lids to trays may be automatically cut. The trays pass by a cutter that is part of the lidding device. The cutter shears the straps thus releasing the lids from the trays.

Another advantage of the present invention is the high rate at which trays may pass through the lidding device. The automated process of removing lids and attaching lids to trays assures that an acceptably high rate.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claim. It is to be understood that both the foregoing general description and the following detailed description are exemplary and explanatory only and are not restrictive of the invention, as claimed. Thus, the present invention comprises a combination of features, steps, and advantages which enable it to overcome various deficiencies of the prior art. The various characteristics described above, as well as other features, will be readily apparent to those skilled in the art upon reading the following detailed description of the preferred embodiments of the invention, and by referring to the accompanying drawings. The accompanying drawings, which are incorporated in and constitute a part of this specification, illustrate embodiments of the invention and, together with the description, serve to explain the principles of the invention.

BRIEF DESCRIPTION OF THE DRAWINGS

For a more detailed description of a preferred embodiment of the present invention, reference will now be made to the accompanying drawings, which form a part of the specification, and wherein.

DETAILED DESCRIPTION OF THE PREFERRED EMBODIMENT

Reference will now be made in detail to exemplary embodiments of the invention, examples of which are illustrated in the accompanying drawings. Wherever possible, the same reference numbers will be used throughout the drawings to refer to the same or like parts.

Figure 1:
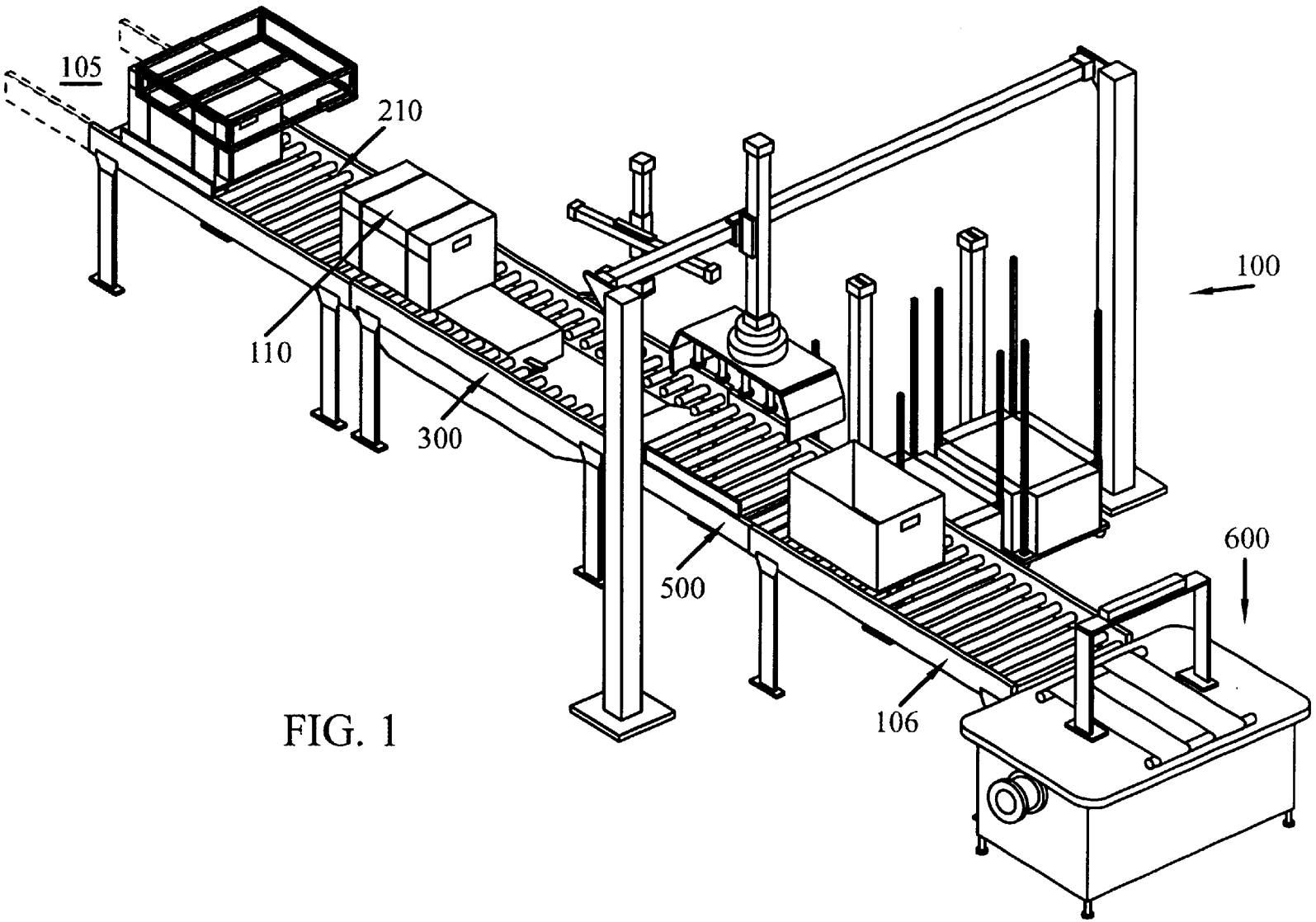
FIG. 1 is an overview of the Lidder/Un-Lidder.

Referring initially to FIG. 1 there is shown an embodiment of the present invention comprising a lidding device 100, or Lidder/Un-Lidder system or Lidder on Un-Lidder. In one embodiment, the Lidder/Un-Lidder has a single module which incorporates all functions in a self-contained system. The single module may contain separate subsystems. Subsystem stations of lidding device 100 include tray transport/tray sizing/lid detection station 200, destrapping station 300, lid station 500, and tray exit/strapper 600. As shown in FIG. 1 the linear arrangement of lidding device 100 allows a workpiece to pass through the device, passing as it does, each of the subsystem stations. In an alternative arrangement the lidding device may be arrange in an L-shaped configuration.

This embodiment of FIG. 1 places input conveyor 105 and exit conveyor 106 in a parallel configuration so that the system is conveniently connected with straight sections of a power roller conveyor 210. This configuration also minimizes the amount of floor space required. Lidder/Un-Lidder 100 can be made to accept different tray sizes that are being transported. Tray transport is accomplished with a power roller, zero pressure accumulation conveyor 210 providing an interface to both upstream and downstream conveyors. Because the Lidder/Un-Lidder never lifts a tray 110, Lidder/Un-Lidder can handle heavy trays, with weights, for example, of 70 lbs. or more.

The embodiment of Lidder/Un-Lidder 100 shown in FIG. 1 can be configured to put lids on or take lids off. There is a discrete point at which the operation can be changed from lidding to unlidding or vice-versa. Trays will have lids installed or trays will have lids removed. In either mode of operation the system can be designed to accommodate a random mix of tray types. In certain embodiments, Lidder/Un-Lidder 100 has a multiple station approach to maximize tray throughput. This allows trays to keep flowing so that each tray operation (for example, tray sizing, strap removal, lid installation or removal, lid retrieval a stacking and tray strapping) is kept simple and is performed at a discrete station. This allows different operations to be performed at the same time, and on a succession of trays. In this manner, lidding device 100 may operate simultaneously on multiple trays that are located at separate stations. Once the system is primed, the tray throughput rate is gated at the longest single in-line operation.

As an example, the system can have a throughput performance of about an average of 20 trays per minute, measured over a one hour period, with a minimum threshold average of 15 trays per minute over one hour. In operation, for example, the system could have less than four unplanned stoppages per hour that require intervention by a human operator.

Figure 2:
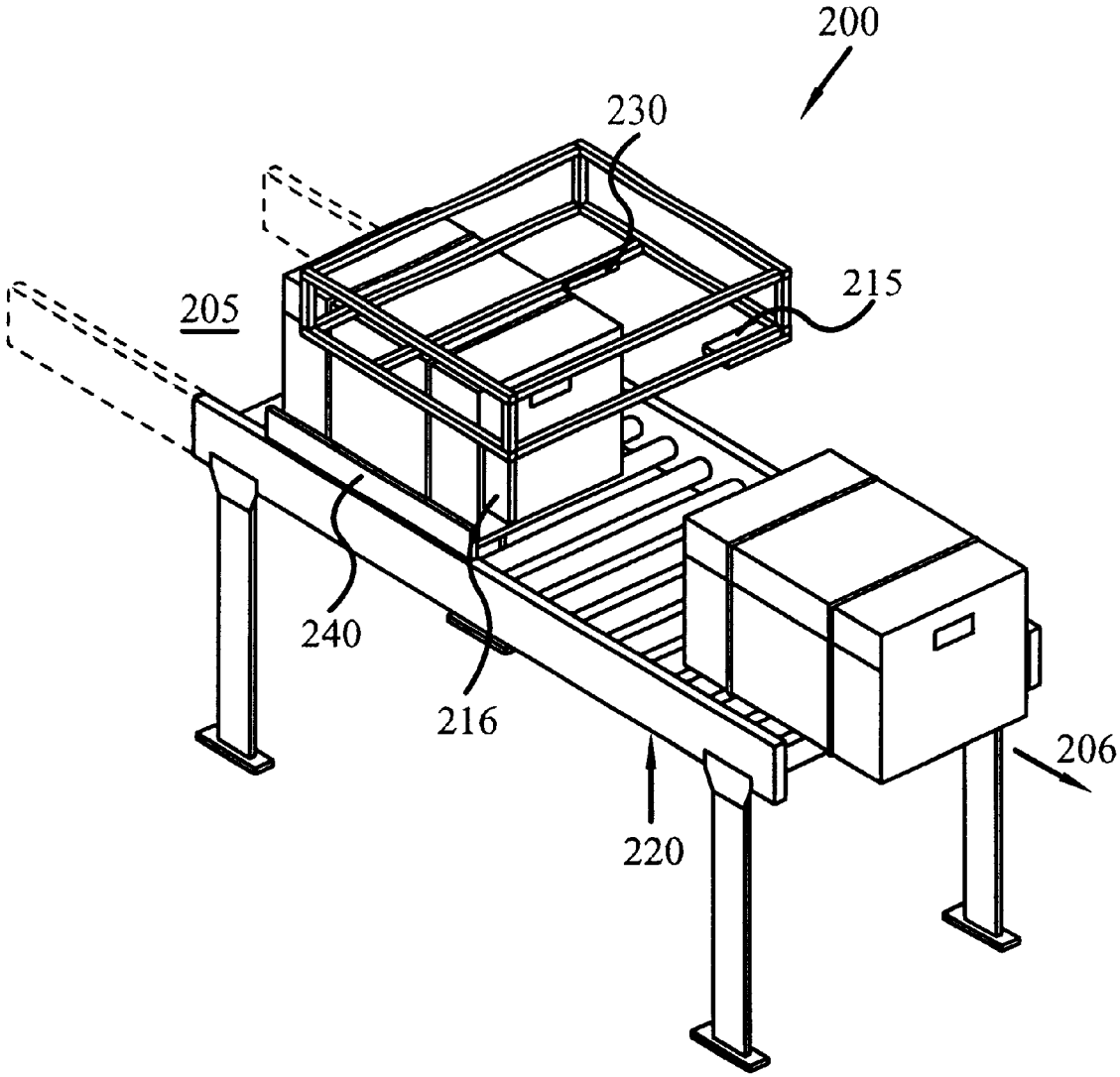
FIG. 2 is a diagram of the tray transport, tray sizing and lid detection station.

Tray transport 200, as shown in FIG. 2, is accomplished with a power roller, zero pressure accumulation conveyor 210. In an embodiment, this type of conveyor is quiet. Conveyor 210 is integrated with the facility's conveyor upstream 205 and downstream 206, and will maintain the same height above the floor, usually between 36" to 72." A mail catcher 220, to catch any random mailpiece that may fall from a tray, may be positioned beneath conveyor 210.

In one embodiment the transport conveyor station is approximately 5 feet in length and comprises two 30 inch zones. Interoll 24:1 high output DC brush motors may be used to provide conveyor 210. Intelliveyor controls for the brush motors, also from Interoll, may be used. The average conveyor speed is approximately 75 to 125 fpm.

Also shown in FIG. 2 is tray sizing and lid detection operation, which is accomplished during tray transport. A set of horizontal 215 and vertical 216 discrete sensors are used to logically determine the tray size from dimensions. In an embodiment, the discrete sensors are discrete Photo Reflective zone sensor arrays. In certain embodiments, lid detection sensors 230 are used to determine if a lid is present on a tray. In an embodiment, lid detection sensors 230 are ultrasonic sensors. Ultrasonic sensors direct an ultrasonic wave at a tray and depending on the reflected signal, determine if a lid is present. Ultrasonic sensors are much less expensive than other types of sensors. In another embodiment (not shown), a video camera can image the top of the trays as they pass through the system. A commercially available image processing board mounted in a control computer can analyze the acquired image and make a determination as to the presence of a lid and/or straps.

Information acquired by ultrasonic sensors or video cameras is combined with tray sizing data and provides inputs into the control system to control the operation.

Also shown in FIG. 2 is tray referencing pusher 240. Large differences in the width of different types of trays requires that the trays be referenced on the conveyor. A pneumatic pusher, when acting as referencing pusher 240, places trays against a common side of conveyor 210.

Figure 3:
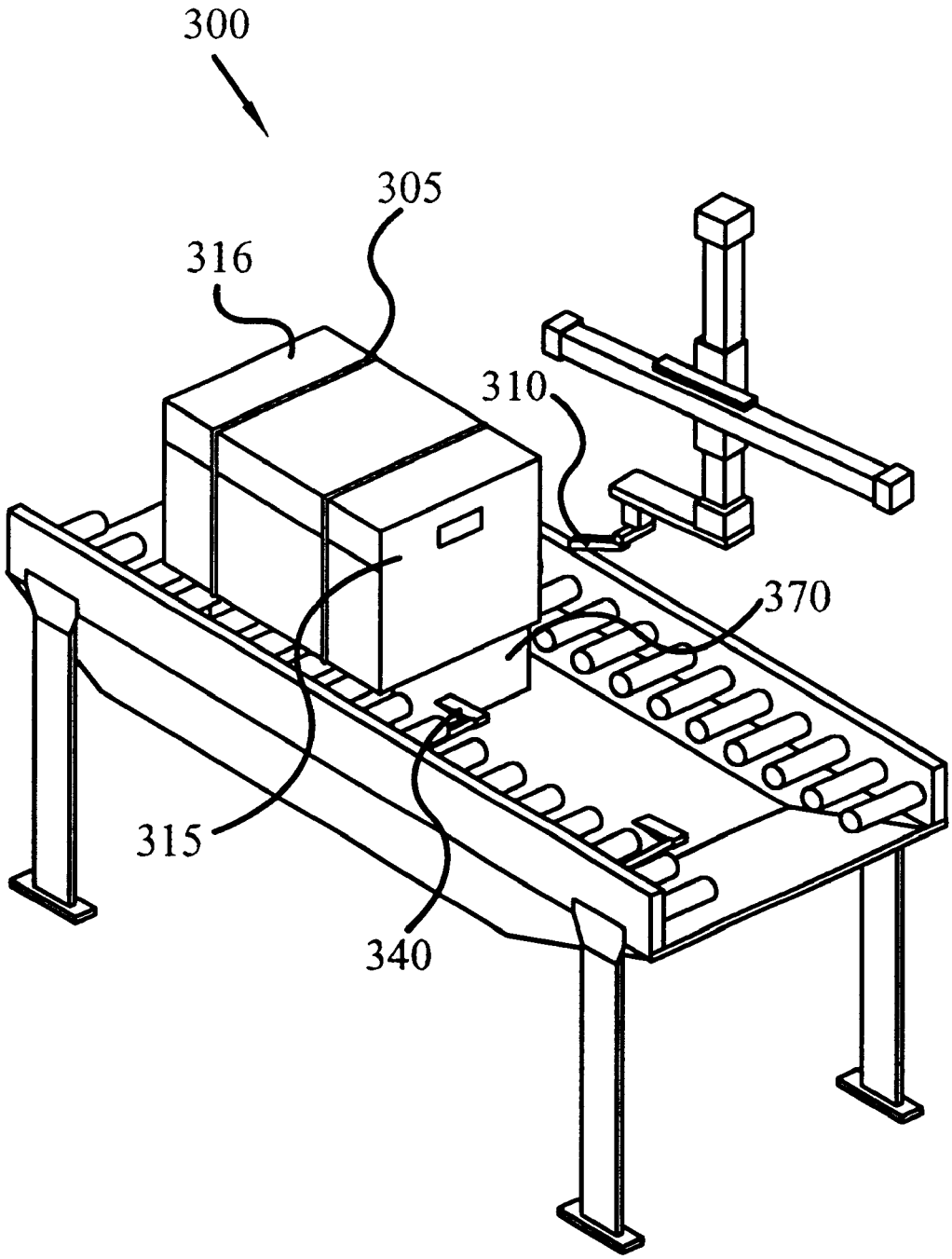
FIG. 3 is a diagram of the unstrapping station.

Referring now to FIG. 3, a de-strapping station 300 is shown. In a certain embodiment the de-strapping station cuts and pulls off strap 305. In certain embodiments, this is done simultaneously. Cut straps can be fed to a vacuum take-away and storage system or dropped into a bin.

Figure 4:
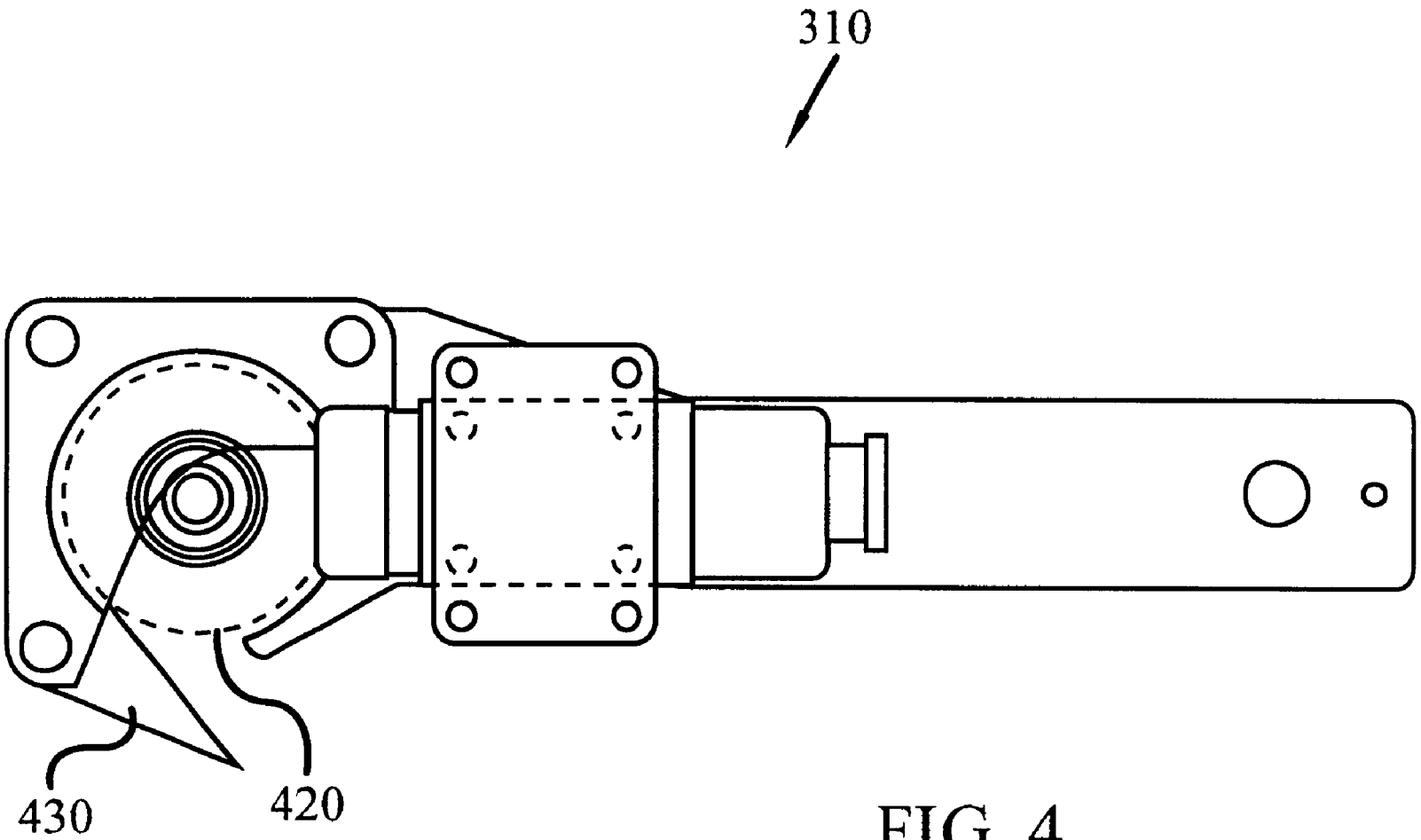
FIG. 4 is a side view of the rotating saw blade.

Strap cutter 310 cuts strap 305. The cut strap then falls and is pulled through a de-strap window (not shown) into a storage system (also not shown). In an embodiment shown in FIG. 4, strap cutter 310 includes a rotating saw blade 430 and a flexible spatula 420. Strap 305 is picked up off the surface of tray 315 by flexible spatula 420 and guided to the rotating saw blade 430 as the assembly is fed through the system. Rotating saw blade 430 cuts through strap 305 when contact is made. In another embodiment, spatula 420 is not flexible. In another embodiment, strap 305 is cut by an ordinary box cutter blade affixed adjacent to spatula 420.

To facilitate the strap cutting operation, the conveyor system may include a tray stop 370 that prevents a tray from sliding in a direction that opposes the cutting operation. Thus, for example, a tray stop may compose a flange of material that prevents a tray from sliding in the direction opposite the movement of the conveyor. Tray stop 370 ensures that the de-strapping operation occurs simultaneously with movement of trays along the conveyor.

In certain embodiments, strap cutter 310 includes a simple hooked blade 330 in combination with flexible spatula 420. In this embodiment, strap 305 is similarly picked up off the surface of tray 315 by flexible spatula 420. In this embodiment, strap 305 is guided over the backside of simple hooked blade 330. A cutting edge on simple hooked blade 330 cuts strap 305 as the assembly is fed through the system. The cutting edge or blade that severs the strap may be a hooked blade, a straight blade, a curved blade or a circular blade.

In certain embodiments, a bottom mechanism 340 provides high speed assurance that the cut strap is pulled clear from tray 315, and fed to the vacuum take-away system. Bottom mechanism 340 acts essentially as a hook, flexible or inflexible, by which to catch loose straps and pull them away from the tray as the tray passes over the bottom mechanism 340. The strap removal function is done below the tray to take advantage of the natural falling tendency of the cut strap. In other embodiments, there is no positive strap removal mechanism. In yet other embodiments, strap removal is done from the sides or top of tray 315.

In operation strap cutter 310 may be brought to engage a tray and strap through several methods, either singly or in combination. In one embodiment strap cutter is held in an essentially static position. The tray is itself brought into position for strap cutter 310 to effectively cut strap 305 by tray referencing pusher 240. Alternatively, strap cutter 310 may be mounted in a biasing device, such as a spring-loaded mechanism or a hydraulic mechanism, such that strap cutter is biased against an edge of tray 315 as the tray passes the de-strapping station. In another alternative, strap cutter 310 may be positioned on a moveable arm or housing. The arm or housing may swing, rotate, or make lateral movement so as to bring strap cutter 310 into engagement with tray 315 as it passes.

In certain embodiments, strap cutter 310 and bottom mechanism 340 of the strap takeaway mechanism utilize similar designs. They are constructed as offset X-Y manipulators with a pair of rodless pneumatic cylinders mounted in an "L" configuration. The ends of each manipulator share a similar design, employing flexible spatula 410 which is brought in contact with tray 315 (both top and bottom) and engages strap 305 by sliding between strap 305 and a lid 316.

In an embodiment of the present invention, the strap take-away system (not shown) is a vacuum powered device which sucks the fallen cut straps down a passage to a reusable vacuum canister. This technique is reliable, high speed, jam proof, and requires little precision. The strap collection canister is mounted remotely for easy access and can utilize a standard and reusable container with a vacuum blower unit used as a lid. Cut straps need not be removed from the container, rather only the container need be changed out.

In certain embodiments, an integral strap chopping system is used, In this embodiment the fallen cut straps are put through a chopper before entering the strap collection canister.

In certain other embodiments, straps are dropped into a collection canister below the strap removal section 300.

Figure 5:
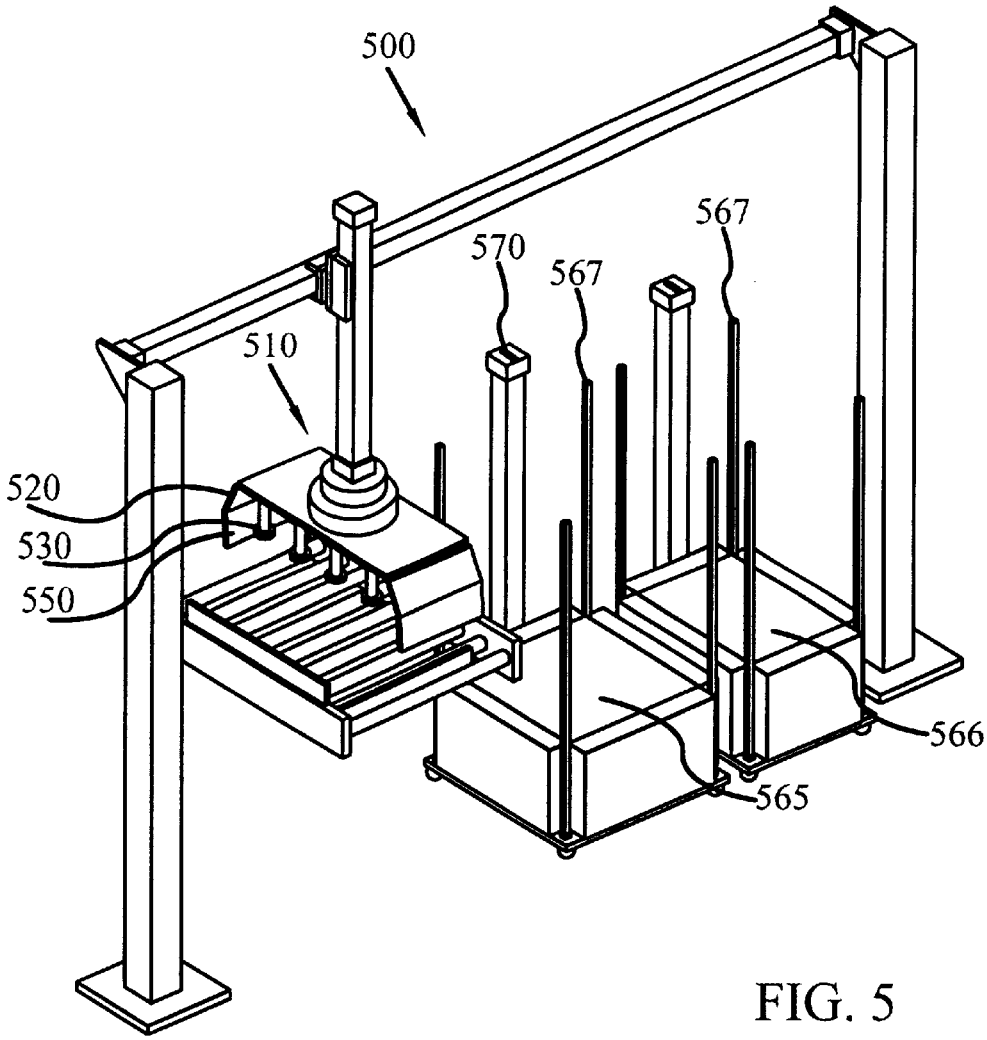
FIG. 5 is a diagram of the lid station.

Referring now to FIG. 5 there is shown a lid station 500. Lid station 500 comprises a lid manipulator 510 to install and remove lids. In the embodiment shown, lid manipulator 510 is slidably-attached to a cross-beam 515. In certain embodiments of the present invention, lid manipulator 510 and cross-beam 515 are a two-axis mechanism made with extrusions and rodless pneumatic cylinders. Lid manipulator 510 and cross-beam 515 are joined so at to allow both vertical and horizontal movement of lid manipulator 510. An end of arm tool 520, at end of lid manipulator 510, is equipped with lid holders 530, for example, suction cups with a vacuum supplied by a set of venturi-style vacuum generators. End of arm tool 520 is mounted to an end of lid manipulator 510. Lid holders may also comprise other devices such as pins, hooks, grips, clamps, and expandable pins, capable of grasping a lid.

Figure 6:
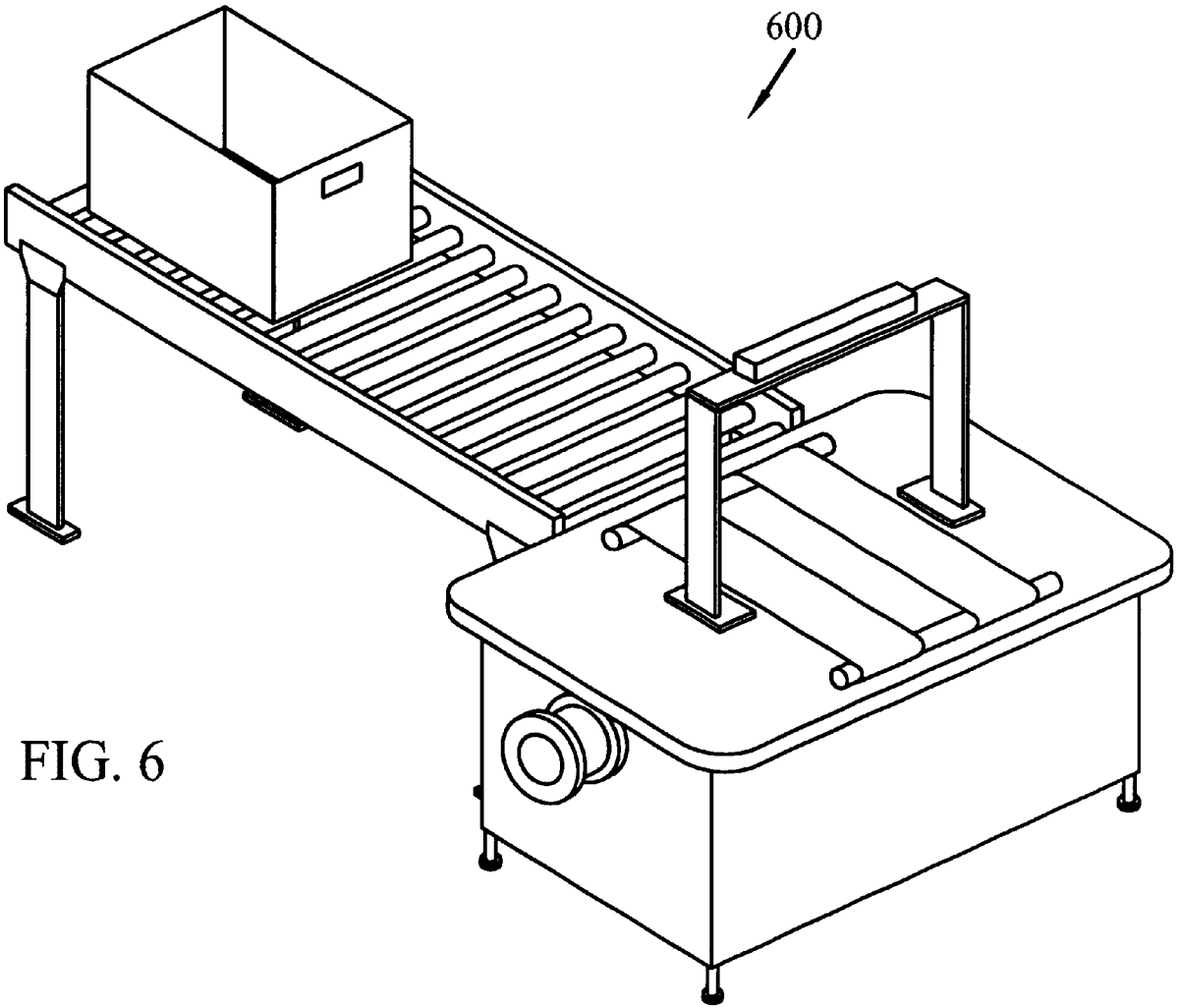
FIG. 6 is a diagram of the strapper.

Based on tray size as determined earlier by discrete sensors 215 and 216, an appropriate unfolded lid is chosen from sorted lids 540 in storage stacks. Lid holders 530 grip and position the appropriate unfolded lid. End mechanisms 550 on end of arm tool 520 contact at least two of the unfolded lid flaps and fold the two flaps toward each other as lid manipulator 510 gently guides the lid flaps between items and the tray sides. When lid manipulator 510 has reached a preset distance from the tray, end mechanisms 550 unfold until the entire mechanism has reached the proper height to engage the tray sides. Once the lidding operation is complete the lid manipulator 510 is lifted away from the lidded tray. The lidded tray is then fed to a strapper 600, as shown in FIG. 6.

In certain embodiments, lid manipulator 510 can accumulate both lidding and unlidding operations. The end of arm tool 520 can perform other insertion articulations as well. The end of arm tool can also be constructed to not have the lid flap manipulators for unlidding only.

In certain embodiments, two removable storage stacks 565 and 566 hold sorted lids 540 for different tray sizes. Lids are placed into a retriever from storage stacks 565 and 566 depending on the operation being performed. Lid storage stacks 565 and 566 are stored adjacent to the conveyor. Floor fixtures 567 are used to locate storage stacks 565 and 566. In addition, a height sensor 570, such as a photo eye, is used to sense height of stacked lids. While only two storage racks are shown, the lidder device can operate with one stack, or more than two stacks of lids.

During operating activities at lid station 500 lids are removed from trays or lids are placed on trays. When operating in lidding mode, lidding device 100 automatically selects the appropriate-sized lid for the tray based on sensor-measured dimensions of the tray. Lid manipulator 510 is moved horizontally to the appropriate lid-storage stack 565 and 566, the stack with the size lid that matches the tray in operation. Lid manipulator 510 then moves vertically such that end of arm tool 520 in cooperation with lid holders 530 grasps a lid. Upon grasping the lid, lid manipulator 510 moves vertically and horizontally so as to place the lid on the tray. End of arm tool 520 thereupon releases the lid. End mechanisms 550 may fold lid edges or flaps so that lid edges are tucked into the tray or outside the tray. In a preferred embodiment, end mechanisms 550 are designed so that end mechanisms operate on opposing edges of a tray at one time, for example the front and back edges, or the right and left edges. When lid manipulator 510 and end mechanisms 550 have, for example, folded and tucked a front and back pair of edges on a tray, lid manipulator 510 can, in a successive operation, radially rotate 90 degrees so as to bring end mechanisms 550 into position to operate on the remaining pair of edges, the right and left pair. In this manner end mechanisms 550 may successively fold and tuck pairs of lid edges.

When the system operates in unlidding mode, lid manipulator 510 removes lids from trays and places the removed lids in lid-storage stacks 565 and 566. This operation begins with end of arm tool 520, in cooperation with lid holders 530, grasping a lid to be removed. Lid manipulator 510 thereupon moves vertically and horizontally so as to place the lid in the appropriate storage stack 565 and 566. At that point end of arm tool 520 releases the lid, and lid manipulator 510 returns to operate on the next tray. If needed, end mechanisms 550 may also operate on the lid edges or flaps so as to unfold the edges. In the meantime the tray from which the lid has been removed has been carried by the conveyor system to the next station.

Referring now to FIG. 6 there is shown tray exit station 600. A commonly available automatic strapper is mounted in the out feed conveyor line. The strapper will operate in automatic mode when the system is in lidding mode. The strapper will move to bypass mode when the system is in unlidding mode.

In certain embodiments, Lidder/Un-Lidder System 100, with the exception of a control enclosure, is completely enclosed in a safety enclosure, eliminating accidental contact with moving components. This enclosure incorporates a standard industrial machine guarding fence. Tray openings at the infeed and outfeed conveyors allow ingress and egress of the trays and the tray openings can be sized to allow all tray sizes to pass through. The tray openings are spaced far enough away from any mechanism so that a person reaching in cannot have their hand in the danger zone. Hinged panels are provided in the fence enclosure at key locations to allow access by personnel to deal with problems and perform maintenance. These panels are equipped with standard industrial interlocks that generate on emergency stop (E-stop) condition if opened. This condition should not automatically reset when the panel is closed. Rather positive operator action can be required to restart the system.

In certain embodiments, E-stops (not shown) are provided on the outside of the safety enclosure for example, at least at each panel, tray opening and at a control panel. In an embodiment, E-stops are placed all around the perimeter such that one is never more than a few feet away and one never has to reach over equipment to access it. The E-stop switches, for example are standard industrial, "mushroom", illuminated red, latched buttons mounted in a standard electrical box. A reset switch is mounted in the same standard electrical box. The E-stop is pulled out to enable a reset, and the reset switch is activated to allow a restart. Certain E-stops are also equipped with restart switches. This allows the operator to restart the system after a procedure such as clearing a jam without having to cross the conveyor back to the control panel.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. One of ordinary skill in the art will recognize that the process just described may easily have steps added, taken away, or modified without departing from the principles of the present invention. Accordingly, the scope of protection is not limited to the embodiments described herein, but is only limited by the claims which follow, the scope of which shall include all equivalents of the subject matter of the claims.

What is claimed is:

1. A device for automatically removing lids from, and placing lids onto, different sized trays, comprising:

means for conveying trays;

a first sensor means to detect the size of a tray;

a second sensor means to detect the presence of a lid; and a lid manipulator means for grasping a lid from a tray conveyed to said lid manipulator for selecting among different sized trays, for namely a lid from a tray when said second sensor means detects the presence of a lid on a tray conveyed by said second sensor means, and for selecting lid and placing onto a tray when said first sensor means detects the size of a tray conveyed by said first sensor means and a lid is not scanned by said 2$^{rd}$ sensor.

2. The device of claim 1 wherein said lid manipulator further comprises a plurality of lid 530 holders capable of grasping a lid.

3. The device of claim 2 wherein said lid holders comprise vacuum cups.

4. The device of claim 1 further comprising at least one end mechanism connected to an end of said lid manipulator, wherein said at least one end mechanism folds lid flaps of a lid held by said lid holders, and said lid manipulator guides the lid onto a positioned tray.

5. The device of claim 1 further comprising a strap cutter wherein said strap cutter cuts straps that hold a lid onto a tray.

6. The device of claim 5 wherein said strap cutter comprises a spatula and cutting edge.

7. The device of claim 6 wherein said cutting edge further comprises a curved blade.

8. The device of claim 6 wherein said cutting edge further comprises a straight blade.

9. The device of claim 1 wherein said means for conveying comprises a powered roller conveyor.

10. The device of claim 1 wherein said means for conveying comprises a conveyor belt.

11. The device of claim 1 wherein said means for conveying further comprises a tray stop.

* * * * *